US007793780B2

(12) United States Patent
Smalley

(10) Patent No.: US 7,793,780 B2
(45) Date of Patent: Sep. 14, 2010

(54) BASKET-TYPE CONTAINERS FOR ARTICLES IN PARTICULAR BOTTLES

(75) Inventor: Brian Leslie Smalley, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 159 days.

(21) Appl. No.: 11/573,525

(22) PCT Filed: Aug. 5, 2005

(86) PCT No.: PCT/US2005/027990

§ 371 (c)(1),
(2), (4) Date: Sep. 8, 2008

(87) PCT Pub. No.: WO2006/020525

PCT Pub. Date: Feb. 23, 2006

(65) Prior Publication Data

US 2009/0008273 A1 Jan. 8, 2009

(30) Foreign Application Priority Data

Aug. 10, 2004 (GB) ..... 0417747

(51) Int. Cl.
*B65D 75/00* (2006.01)

(52) U.S. Cl. ..... 206/164; 206/162; 206/163; 206/166; 206/172

(58) Field of Classification Search ..... 206/141–143, 206/162–166, 172, 187, 188, 185
See application file for complete search history.

(56) References Cited

U.S. PATENT DOCUMENTS

| | | | | | |
|---|---|---|---|---|---|
| 3,229,849 | A | * | 1/1966 | Spillson | 206/179 |
| 4,308,950 | A | * | 1/1982 | Wood | 206/188 |
| 4,362,240 | A | * | 12/1982 | Elward | 206/188 |
| 4,374,561 | A | * | 2/1983 | Stout et al. | 206/188 |
| 4,413,729 | A | * | 11/1983 | Wood | 206/188 |
| 4,480,746 | A | * | 11/1984 | Wood | 206/141 |
| 4,722,437 | A | * | 2/1988 | Walsh | 206/170 |
| 4,927,009 | A | * | 5/1990 | Stout | 206/188 |
| 5,695,051 | A | * | 12/1997 | Hart | 206/198 |
| 6,131,729 | A | * | 10/2000 | Eckermann et al. | 206/178 |
| 2003/0111363 | A1 | | 6/2003 | Theelen | |

FOREIGN PATENT DOCUMENTS

| | | |
|---|---|---|
| EP | 1 319 607 A1 | 6/2003 |
| WO | WO 97/05026 | 2/1997 |

* cited by examiner

*Primary Examiner*—David T Fidei
(74) *Attorney, Agent, or Firm*—Womble Carlyle Sandridge & Rice, PLLC

(57) ABSTRACT

A carrier device with article receiving compartments on either side of a partial central wall and handle portion. The handle being separate from the central wall and moveable relative thereto between a raised position and a lowered position. The handle can be retained in either the raised or lowered positions by hook formations and is connected to the carrier device by interconnecting webs extending from the side walls.

16 Claims, 7 Drawing Sheets

BASKET-TYPE CONTAINERS FOR ARTICLES IN PARTICULAR BOTTLES

CROSS-REFERENCE TO RELATED APPLICATIONS

This application is the national stage of international application no. PCT/US2005/027990, filed Aug. 5, 2005, which claims the benefit of Great Britain application no. GB 0417747.3, filed Aug. 10, 2004.

INCORPORATION BY REFERENCE

The entire contents of international application no. PCT/US2005/027990, filed Aug. 5, 2005, and Great Britain application no. GB 0417747.3, filed Aug. 10, 2004, are hereby incorporated by reference as if presented herein in their entirety.

This invention relates to containers for articles and more particularly to basket style containers usually for carrying bottles.

BACKGROUND

Basket style containers normally have a central lengthwise extending wall which leads into an upstanding handle portion. On each side of the central wall is an open topped compartment section for receiving a number of bottles. Further, divider walls generally are also provided inside each compartment section so as to define individual pockets for each bottle. When fully erected, the container has a base, a pair of end wall means generally perpendicular to the central wall and a pair of side walls generally parallel to the central wall and hingedly connected to the end walls.

It is common for the containers to be supplied to an end user, such as a beverage manufacturer, in a flat condition either fully glued or glued except for a pair of base panels. The end user then runs the containers on a packing machine which opens the containers and inserts the bottles, having closed the base panels where necessary.

In EP-A-1319607 there is provided a paperboard basket type carrier device having a lengthwise extending central wall, article receiving compartments on both sides of the central wall and a handle portion, each receiving compartment being defined by a base wall, a side wall substantially parallel to the central wall, a pair of end walls extending between and hingedly connected to the side wall, and the central wall with compartment dividers being folded out from the central wall and adhesively secured to the side walls, the handle portion being separate from the central wall, being movable relative thereto between a raised position and a lowered position and being connected to the remainder of the carrier device by means of interconnecting webs extending from the pair of side walls, a releasable interconnection being provided between the handle portion and the remainder of the carrier device to retain the handle portion in its lowered position.

SUMMARY

According to the present invention there is provided a paperboard basket type carrier device having a lengthwise extending central wall, article receiving compartments on both sides of the central wall and a handle portion, each receiving compartment being defined by a base wall, a side wall substantially parallel to the central wall, a pair of end walls extending between and hingedly connected to the side wall, and the central wall compartment dividers being folded out from the central wall and adhesively secured to the side walls, the handle portion being separate from the central wall, being movable relative thereto between a raised position and a lowered position and being connected to the remainder of the carrier device by means of interconnecting webs extending from the pair of side walls, a releasable interconnection being provided between the handle portion and the remainder of the carrier device to retain the handle portion in its lowered position and the releasable interconnection comprising a hook formation formed on each of a pair of downward extension of the handle portion and a cooperating edge formed in one of the compartment dividers at a location adjacent the central wall, one extension being provided on each side of the central wall.

An interconnecting web can be provided at each lengthwise end of each side wall and also the interconnecting webs are of multiple thickness. Conveniently creases are provided in the interconnecting webs to facilitate movement of the handle portion between its raised and lowered positions.

The base wall can have a central fold extending from one end wall to the other.

The downward extensions can have an angled cutaway lower edge portion below the hook formations and also the downward extensions can have an angled cutaway lower edge portion at the end opposite the hook formations.

In addition, each cooperating edge is constituted by the folding of one of the compartment dividers.

An embodiment of the present invention will now be described in more detail.

DETAILED DESCRIPTION

Figure 1:
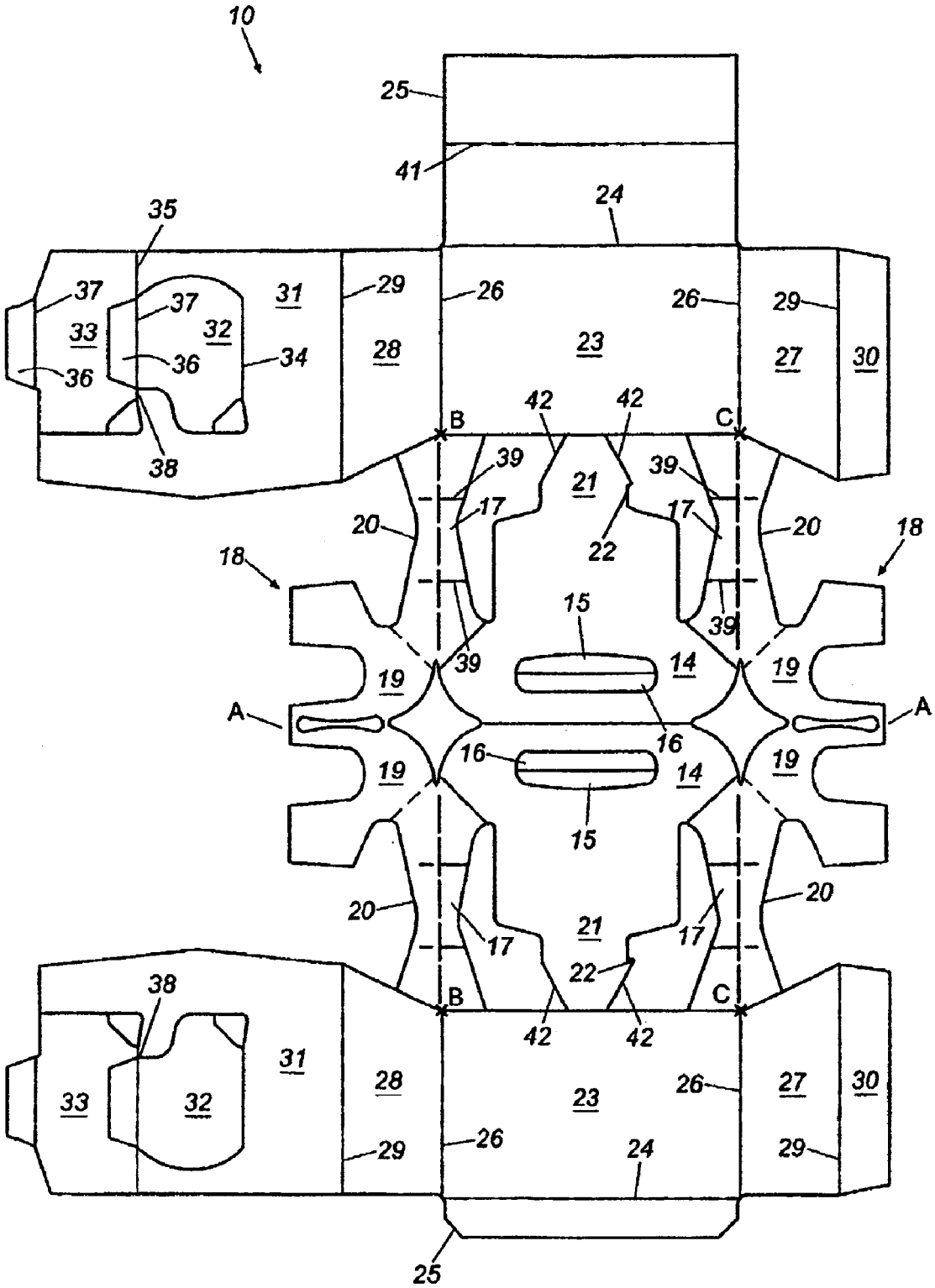
FIG. 1 shows a blank for producing a basket type carrier device according to the present invention.
Figure 2:
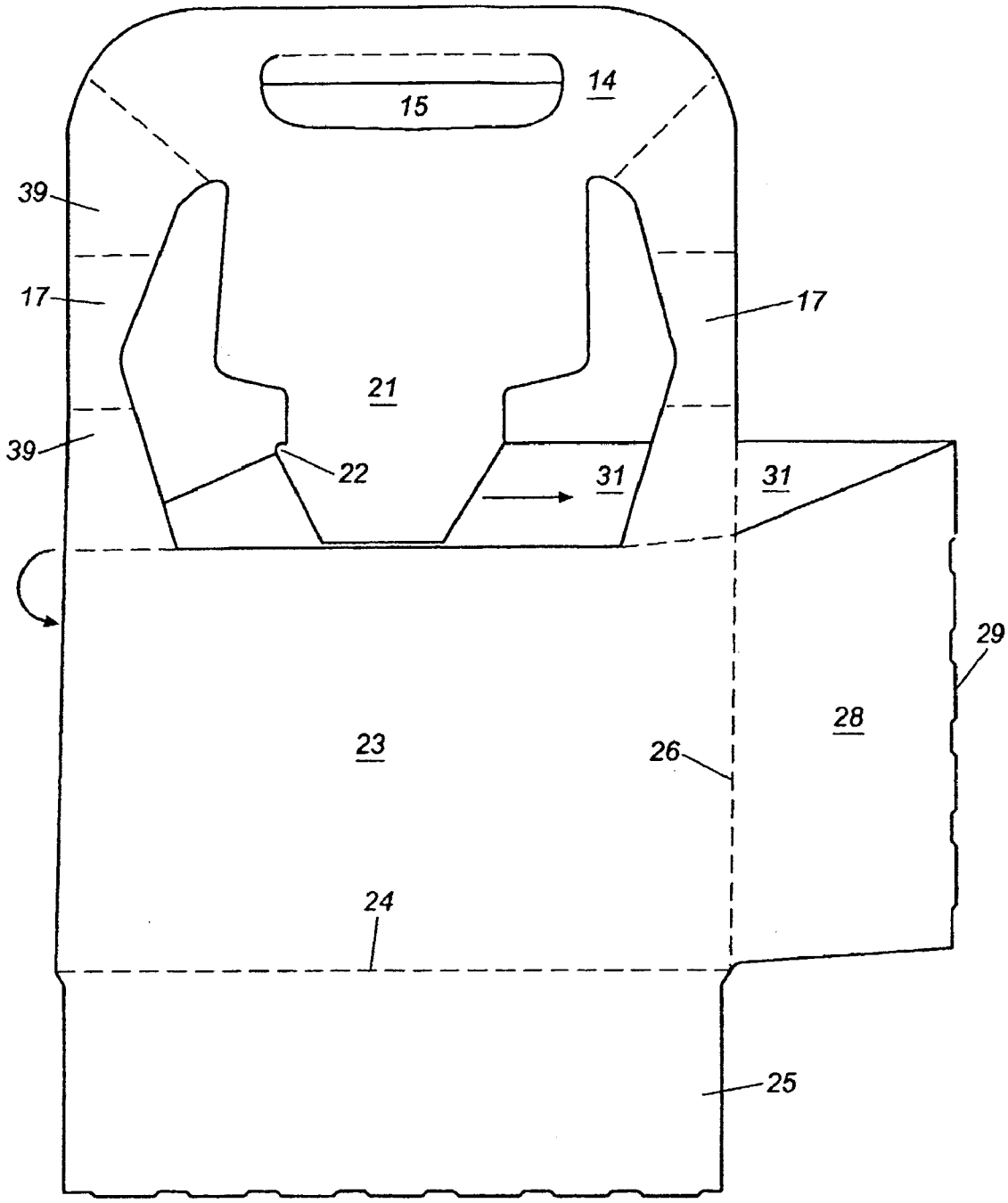
FIG. 2 is a side view of the assembled carrier device in a flat-folded condition.

In the figures there is shown a paperboard blank 10 for producing a basket-type carton 11 for carrying a number of articles as a multipack. In the arrangement shown, the articles are bottles 12 having bottle closures 13 and the carton 11 is designed to carry a total of six bottles 12 in two rows of three. It will be evident on reading the specification, however, that other articles could be carried and there could be more than three articles in each row.

The blank 10 provides two main handle panels 14 which are connected along a fold line A-A. The main handle panels 14 each have a handle aperture 15 complete with a tuck flap 16, which is known for providing added comfort when the loaded carton 11 is being carried.

Each main handle panel 14 is hingedly connected at each lengthwise end to an interconnecting web 17. Reinforcing panels 18 which have handle reinforcing portions 19 and web reinforcing sections 20 are hingedly connected to the respective main handle panels 14 and to the interconnecting webs 17 along fold lines B-B and C-C. Each main handle panel 14 also has an extension 21 which terminates in a hook formation 22 at one end.

Each interconnecting web 17 is hingedly connected remote from the handle panel 14 to a side wall 23 which in turn is hingedly connected at its lower edge 24 to a main base panel 25 at one side and a secondary base panel 25 in the form of a glue panel at the other side. Alternatively, interlocking formations could be employed to secure the base, as is known in the industry. Each side wall 23 has an interconnecting web 17 at each lengthwise end. The main base panel 25 has a lengthwise fold 41 which is centrally disposed between the side walls 23 when the carton is assembled.

At each end edge 26 of each side wall 23, a partial end wall 27, 28 is hingedly connected. Hingedly connected along folds 29 to each partial end wall 27, 28 is a partial center wall 30, 31. Lateral dividers 32, 33 are cut from the partial center walls 31 to be hinged about folds 34, 35. Each lateral divider 32, 33 has an adhesive tab 36 cut therefrom which tab is hingedly connected to the lateral divider by means of fold 37.

Assembly of the carton 11 is as follows. First, the reinforcing panels 18 are folded about folds B-B and C-C and adhesively secured to the inside of the main handle panels 14 and the interconnecting webs 17. Next, the partial center walls 31 are folded through 180° about folds 29 so as to lie against the adjacent partial end wall 28 and the side wall 23. Glue is applied to the adhesive tabs 36 of the lateral dividers 32, 33 to secure them to the respective side walls 23.

The other partial center walls 30 together with their associated partial end walls 27 are then folded through 180° about the edges 26. Glue is applied to the upper part of the partial center walls 30 to secure them to the respective partial center walls 31 which is overlapped.

The part-assembled carton 11 is then folded about fold A-A and the two reinforced handle panels 14 are adhesively secured to each other, but the extensions 21 are not secured to each other. Also adhesively secured together are the parts of the partial walls 30, 31 around, but not including, the lateral dividers 32, 33. The base panels 25 can then be secured relative to each other either before or after bottles have been inserted into the article receiving compartments defined by the partial end walls, the center wall, the side walls and the base panels. Each extension 21 remains on the outside of its respective center wall.

It will be clear that the assembled carton 11 can in this embodiment be assembled into a flat condition which can be opened up when articles are to be inserted.

Figure 3:
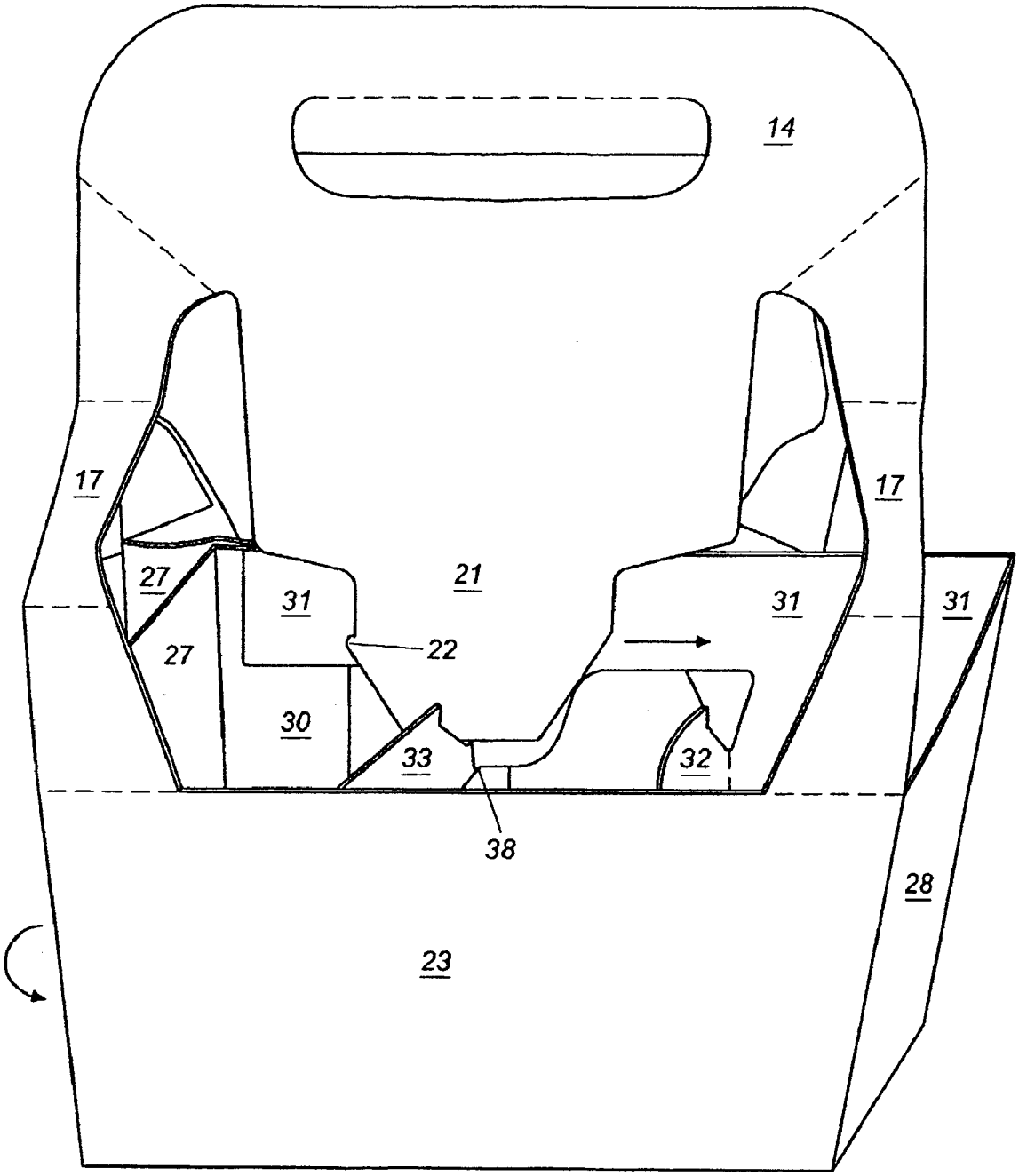
FIG. 3 is a perspective side view of the carrier device being opened up.
Figure 4:
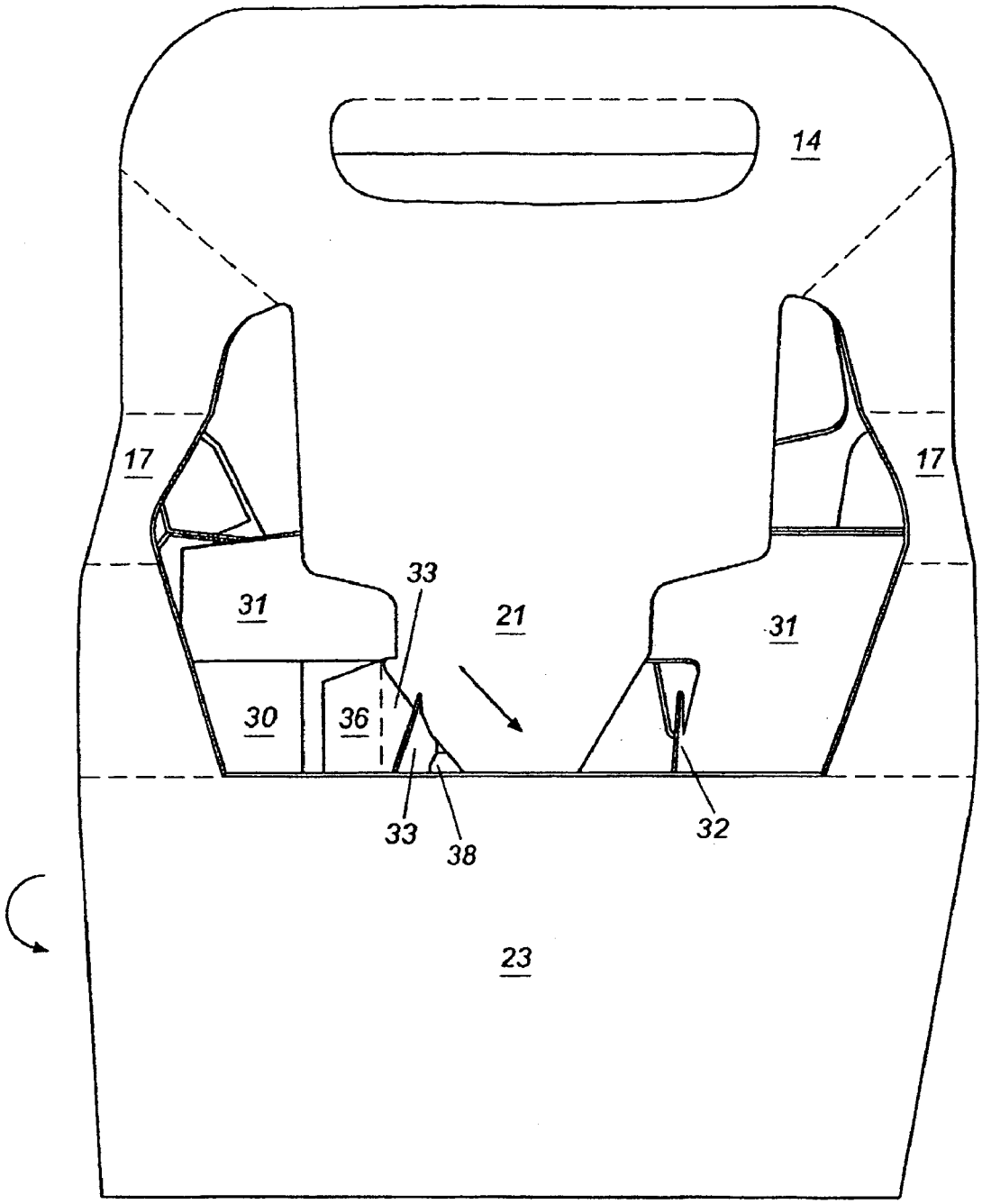
FIG. 4 is a perspective side view of the carrier device in a further opened up condition.
Figure 5:
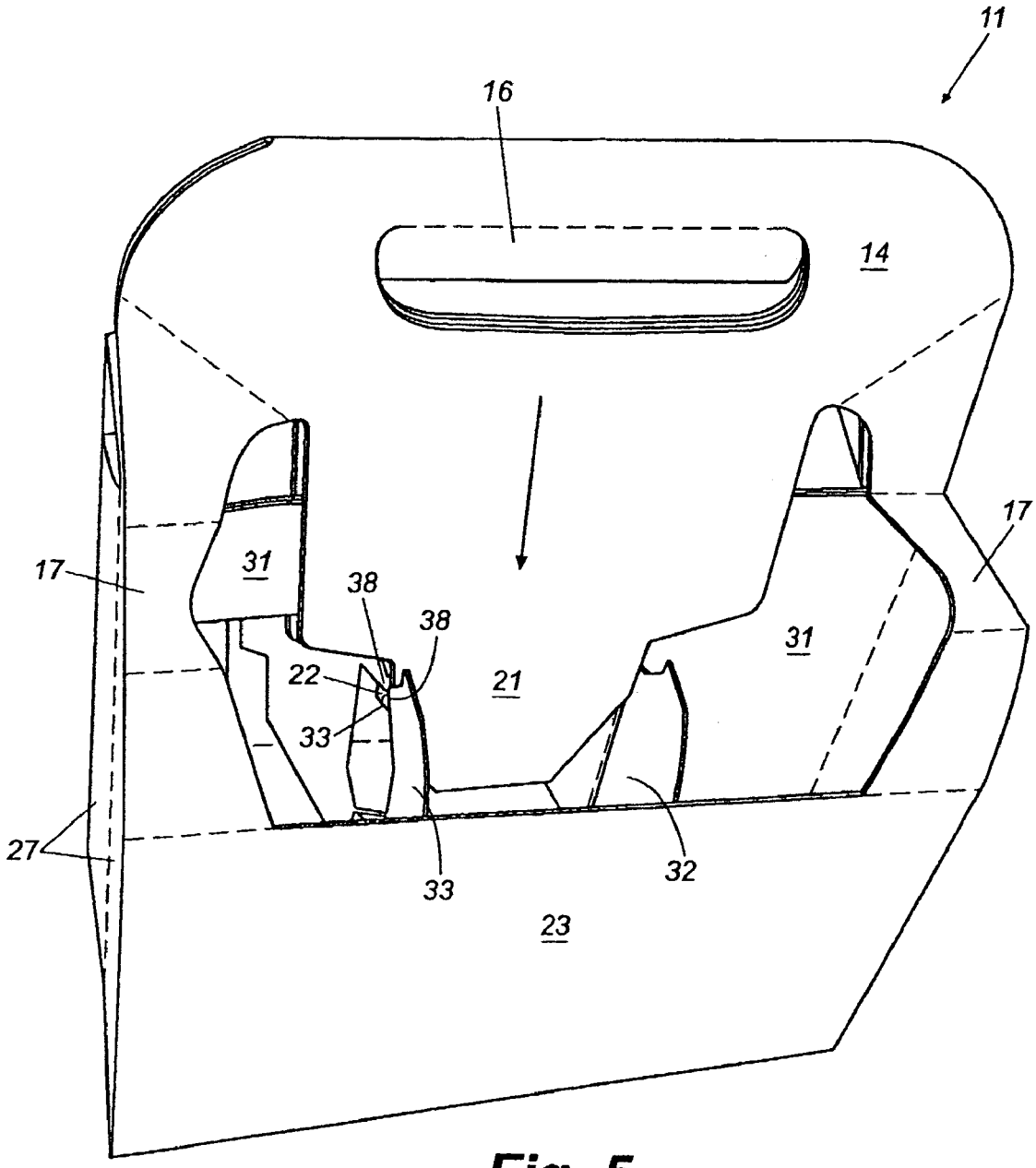
FIG. 5 is a perspective side view of the carrier device in a fully opened condition ready to receive articles.
Figure 6:
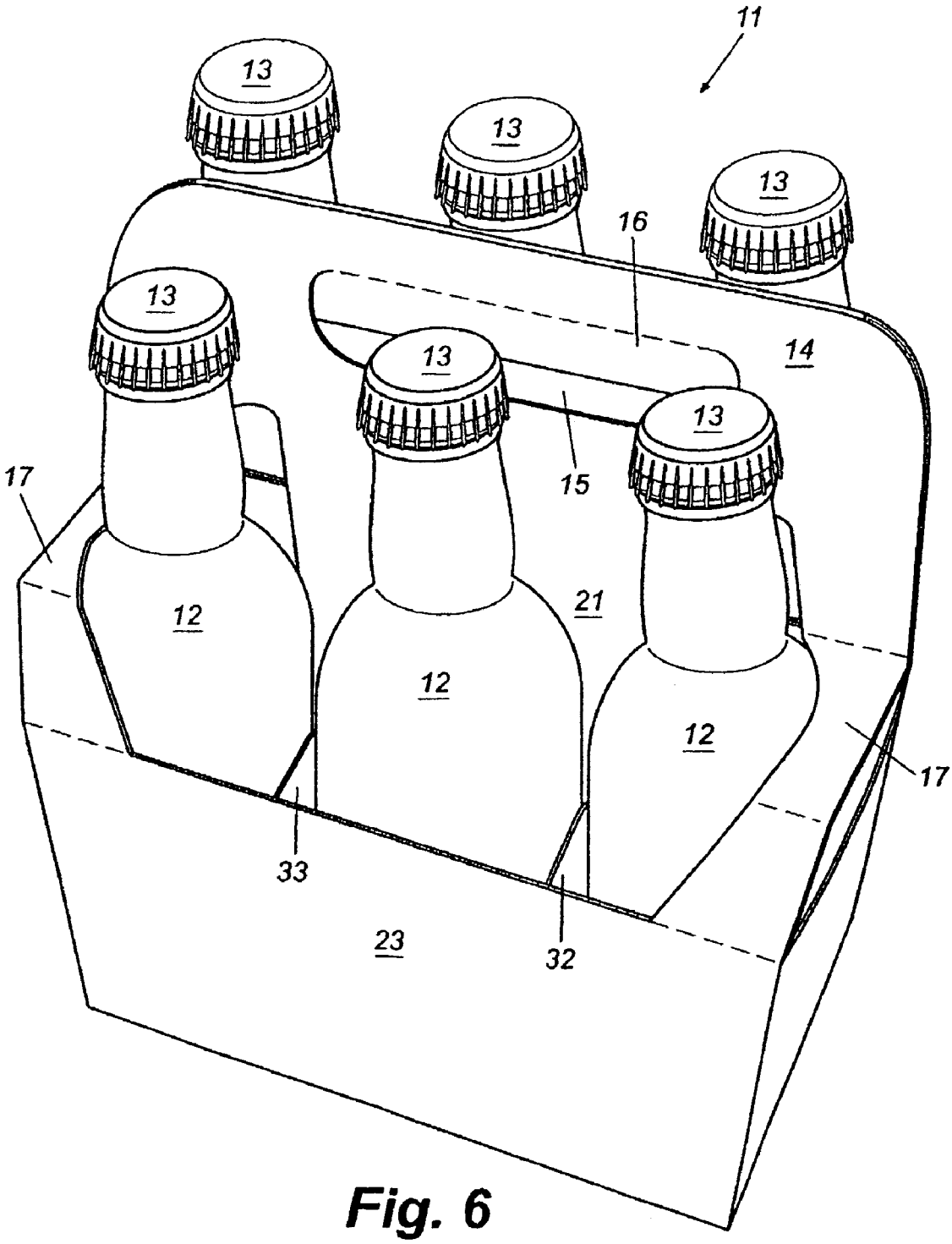
FIG. 6 is a perspective view of the loaded carrier device with the handle lowered.
Figure 7:
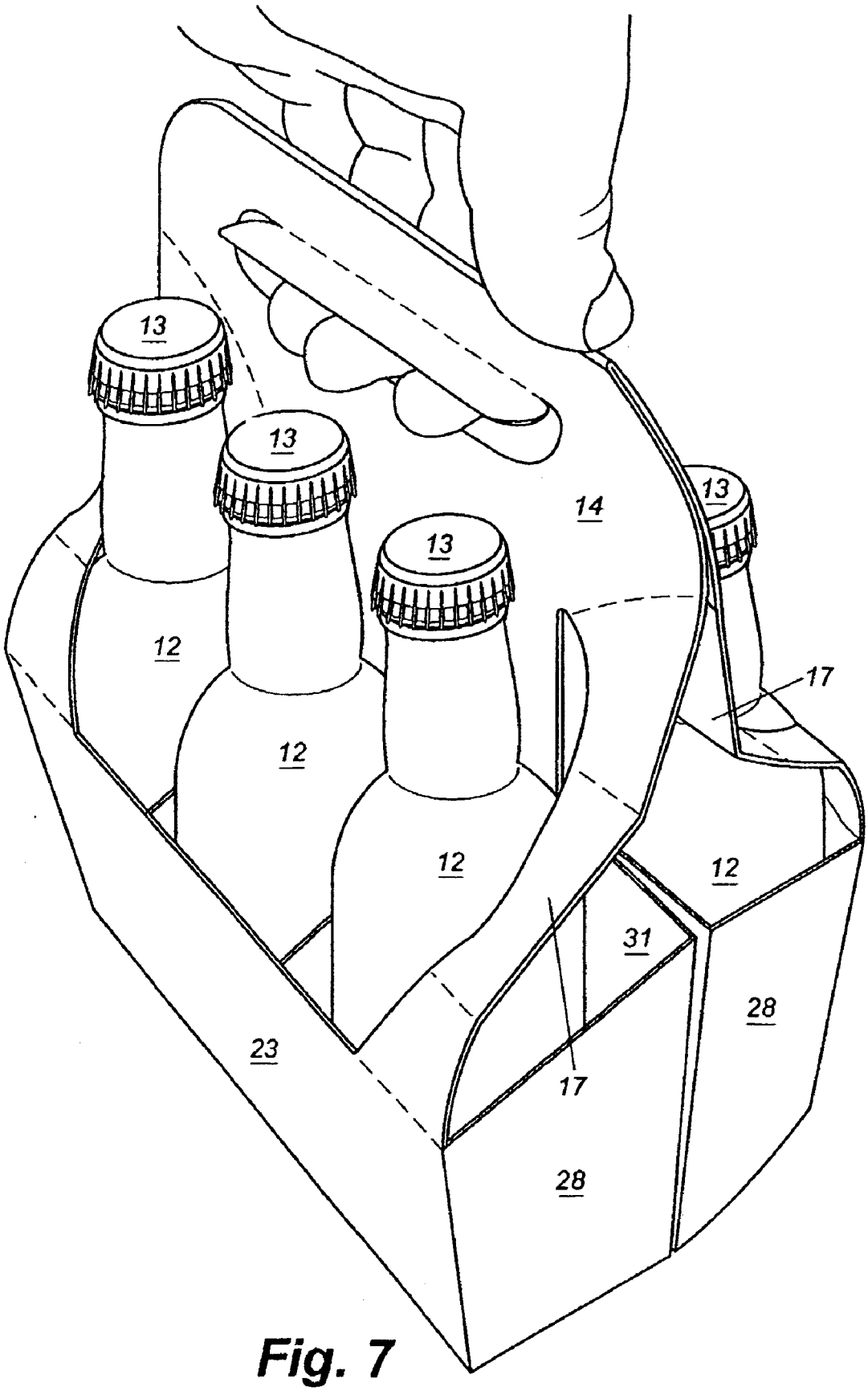
FIG. 7 is a perspective view of the loaded carrier device being carried with the handle raised.

When the carton 11 is opened up, hook receiving edges or notches 38 become apparent where the lateral dividers 33 hinge out of the plane of the partial center wall 31. The handle section 14, 21 is attached to the article receiving compartments only by means of the four reinforced interconnecting webs 17. The handle section 14, 21 is, therefore, movable up and down relative to the center wall 30, 31 of the carton 11. The pair of extensions 21 which, when assembled, extend downwardly from the main handle panels 14 on both sides of the center wall are dimensioned such that the hook formations 22 can engage in the notches 38 so as to retain the handle section 14, 21 in a lowered position. The extensions each have at each end an angled cutaway 42 below the hook formation 22 to allow passage of the lateral divider 33 when the pack is being opened up and the handle lowered as shown clearly in FIGS. 3 and 4. The provision of unglued extensions 21 both either side of the central wall gives the pack symmetry and helps to keep the central wall central. Generally, with the bottles 12 inserted, the main handle panels 14 do not project above the bottles when the handle section 14, 21 is in its lowered position. This is ideal for storage and stacking.

An end user can, however, grasp the handle by way of the handle apertures 15 and lift the handle. The interengagement of the hook formations 22 in the notches 38 is readily overcome to allow the handle section 14, 21 to move upwardly such that the handle apertures 15 are above the bottles 12. Optional creases 39 in the interconnecting webs 17 may be provided to facilitate the movement between the lowered and raised positions.

The carton 11 illustrated has a four ply handle area 14 with reinforced webs 17, but the reinforcement may not be necessary depending on the weight to be carried and the strength of the paperboard. Also, the carton 11 could be readily modified to carry more or even less bottles than the six illustrated.

The invention claimed is:

1. A paperboard basket carrier having two sides and two ends, the carrier comprising:

a lengthwise extending central wall having a first side and a second side;

a plurality of central wall compartment dividers, at least one divider folded out from the central wall extending from each side of the central wall;

a handle portion having a pair of downward extensions, one extension of the pair being located on the first side of the central wall and the other extension of the pair being located on the second side of the central wall, at least one hook formation being formed in the pair of downward extensions;

a base wall at a bottom of the carrier;

a pair of end walls, one end wall being located at each end of the carrier;

a pair of side walls, one side wall being located at each side of the carrier, each central wall compartment divider being adhesively secured to one of the side walls;

interconnecting webs extending from the pair of side walls to the handle portion; and a plurality of article receiving compartments, at least two article receiving compartments being located on each side of the central wall, each article receiving compartment being defined at least in part by the base wall, one of the side walls, the central wall, and at least one of the central wall compartment dividers, wherein the hook formation is removably engageable with a cooperating edge formed in one of the compartment dividers and located adjacent to the central wall so that the handle portion is movable relative to the central wall between a raised position and a lowered position.

2. The carrier of claim 1, wherein one of the interconnecting webs is located at each end of each side wall.

3. The carrier of claim 2, further comprising creases in the interconnecting webs.

4. The carrier of claim 2, wherein the base wall has a central fold extending between the end walls.

5. The carrier of claim 2, wherein each downward extension has an angled cutaway lower edge portion.

6. The carrier of claim 1, wherein the plurality of dividers comprises at least two dividers extending from each side of the central wall.

7. The carrier of claim 6, wherein the at least two dividers on each side of the central wall are struck from a partial center wall, the partial center wall comprising a part of the central wall.

8. A paperboard blank, comprising:

a pair of partial center walls, each partial center wall being hingedly connected to a pair of dividers;

a plurality of partial end walls, each partial center wall being hingedly connected to one of the partial end walls;

a pair of side walls, each side wall being hingedly connected to at least one of the partial end walls;

a base panel hingedly connected to one of the side walls; and a pair of handle panels, each handle panel being connected to one of the side walls by two interconnecting webs, wherein each handle panel includes a downward extension having a hook formation, and wherein cooperating edges are formed in the compartment dividers, the pair of dividers of each partial center wall comprising a first divider and a second divider, each of the first dividers comprising a first tab foldably connected to the first divider and each of the second dividers comprising a second tab foldably connected to the second divider, wherein the first and second tabs are for being folded with respect to the respective first and second dividers.

9. The blank of claim 8, wherein one of the interconnecting webs is connected to each end of each side wall.

10. The blank of claim 9, further comprising creases in the interconnecting webs.

11. The blank of claim 8, wherein the base panel has a central fold.

12. The blank of claim 8, wherein each downward extension has an angled cutaway lower edge portion.

13. The blank of claim 8, further comprising a pair of reinforcing panels, each reinforcing panel being hingedly connected to one of the interconnecting webs.

14. The blank of claim 8, wherein the second divider of each pair of dividers is connected to the respective partial center wall at a fold line and the first tab of each first divider extends past the fold line of the respective second divider.

15. The blank of claim 14, wherein the first tab is foldably connected to a respective first divider at a tab fold line that is collinear with the fold line connecting each respective second divider to a respective partial center wall.

16. The blank of claim 8, wherein the first and second tabs are for being attached to a respective one of the side walls, the first and second tabs protrude from a respective first and second divider and are for being oriented generally parallel to the side walls when the blank is erected into a carrier.

* * * * *